US008079287B2

(12) United States Patent
Castillo

(10) Patent No.: US 8,079,287 B2
(45) Date of Patent: Dec. 20, 2011

(54) AUTO-ALIGNABLE KNOB

(75) Inventor: Octavio Lugo Castillo, Queretaro (MX)

(73) Assignee: Mabe, S.A. de C.V., Queretaro (MX)

( * ) Notice: Subject to any disclaimer, the term of this patent is extended or adjusted under 35 U.S.C. 154(b) by 824 days.

(21) Appl. No.: 12/120,770

(22) Filed: May 15, 2008

(65) Prior Publication Data

US 2009/0151505 A1 Jun. 18, 2009

(30) Foreign Application Priority Data

Dec. 18, 2007 (MX) ..... MX/A/2007/016325

(51) Int. Cl.
*F17C 13/04* (2006.01)
*H01H 3/10* (2006.01)
*G05G 1/12* (2006.01)

(52) U.S. Cl. ..... 74/553; 74/548; 16/441; 431/256

(58) Field of Classification Search ..... 74/10 R, 74/10.22, 10.7, 522, 525, 548, 553; 251/207; 126/39 G, 39 N; 200/61.86, 11 R; 137/315.15, 137/315.35; 403/357; 29/896.5; 16/441; *H01H 3/08, 3/10; G05G 1/10, 1/12; F17C 13/04; F16K 31/60*

See application file for complete search history.

(56) References Cited

U.S. PATENT DOCUMENTS

| | | | | | |
|---|---|---|---|---|---|
| 2,899,841 | A | * | 8/1959 | Melloy | 74/548 |
| 3,994,608 | A | * | 11/1976 | Swiderski et al. | 403/372 |
| 4,201,096 | A | | 5/1980 | Morrison et al. | |
| 4,779,305 | A | * | 10/1988 | Gorsek | 16/441 |
| 4,794,945 | A | * | 1/1989 | Reback | 137/315.12 |
| 4,842,009 | A | * | 6/1989 | Reback | 137/315.15 |
| 5,509,174 | A | | 4/1996 | Worrell | |
| 6,079,401 | A | | 6/2000 | Alvord et al. | |
| 6,438,771 | B1 | * | 8/2002 | Donath et al. | 4/678 |
| 6,520,481 | B2 | | 2/2003 | Harneit | |
| 6,627,828 | B1 | | 9/2003 | McCartney | |

FOREIGN PATENT DOCUMENTS

| | | |
|---|---|---|
| BR | PI 0105277-2 A | 8/2003 |
| BR | PI 0105346-9 A | 8/2003 |
| CN | 1624615 | 6/2005 |
| EP | 0586825 | 3/1994 |

(Continued)

*Primary Examiner* — James Pilkington
*Assistant Examiner* — Thomas Diaz
(74) *Attorney, Agent, or Firm* — Enrique J. Mora; Beusse Wolter Sanks Mora & Maire, P.A.

(57) ABSTRACT

An auto-alignable knob for a home appliance includes an offspring box self-connectable with a valve shaft. A mobile box has at least one lateral face including a pin. The mobile box is coupled to the offspring box to allow a free movement relative to one another along a first axis. A fixed box includes an indentation and a groove. The mobile box is insertable to the fixed box by insertion of the pin of the lateral face through the groove. The pin of the mobile box provides a respective degree of freedom to the mobile box relative to the indentation of the fixed box along at least a second axis normal to the first axis. A mechanical coupling established between the indentation of the fixed box and the pin of the mobile box is configured to provide a degree of rotational freedom about one of the axes, and a combined mechanical coupling established between the offspring box, the mobile box and the fixed box is configured to provide a respective degree of freedom along a third axis perpendicular to the first and second axes.

14 Claims, 6 Drawing Sheets

FOREIGN PATENT DOCUMENTS

| | | | |
|---|---|---|---|
| GB | 2130438 | A | 5/1984 |
| GB | 2225626 | A | 6/1990 |
| GB | 2253898 | A | 9/1992 |
| GB | 2389638 | A | 12/2003 |

* cited by examiner

Fig. 3
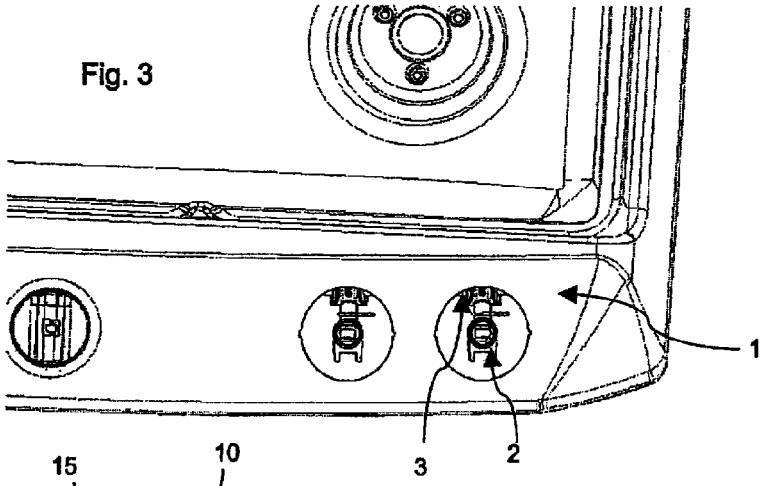
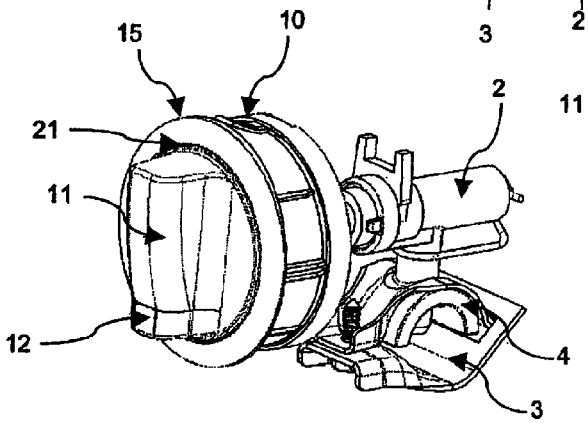
Fig. 4
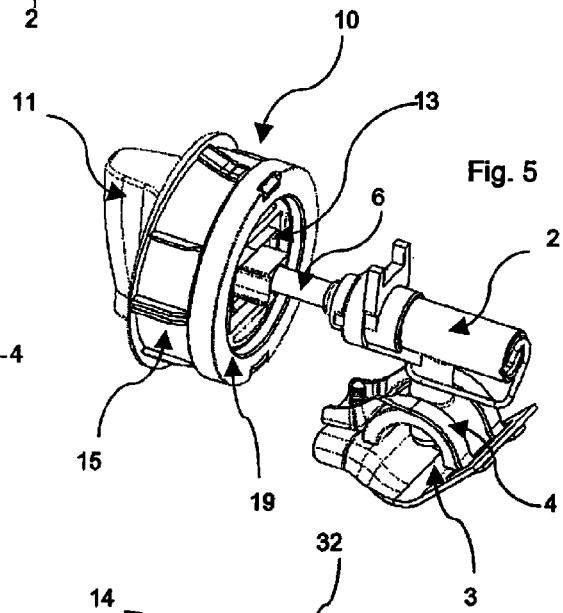
Fig. 5
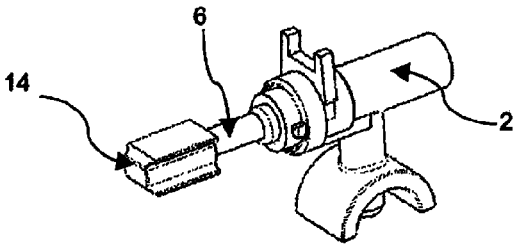
Fig. 6
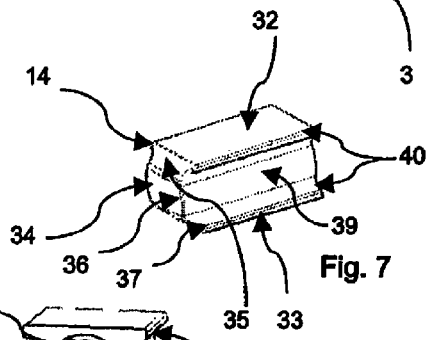
Fig. 7
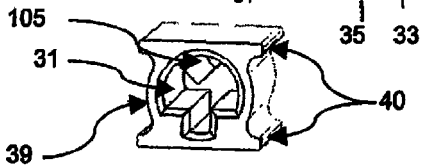
Fig. 8

AUTO-ALIGNABLE KNOB

RELATED APPLICATIONS

This application claims priority from Mexican application Ser. No. MX/a/2007/016325 filed Dec. 18, 2007, which is incorporated herein by reference in its entirety.

FIELD OF THE INVENTION

The present invention refers to a rotating knob, and more specifically refers to a rotating knob for home appliances, capable of auto-aligning with communication mechanisms from said appliances, while keeping an aesthetically pleasing appearance, independent of the internal variations of the apparatus, as well as an assembly method of said knob.

PRIOR ART SPECIFICATION

In home appliances, particularly dishwashing machines, washing machines, dryers, stoves, ranges, ovens and general electro domestics, rotary knobs are provided so that, by means of user interaction, the operation requirements are established, programming is established, the apparatus is turned on or off, actuates the indicators, etcetera, wherein the knobs are usually coupled by brackets to actuation axis, wherein the valves, contacts, etcetera are found, to actuate the appliance and wherein the actuation axis are coupled to the axis to hold the knob system.

Due to aesthetic reasons in home appliances, as well as security reasons, the knobs must be correctly mounted in regards to the actuation axes. The actuation axes in home appliances, due to possible errors in the assembly line and the components used for the manufacture of the actuation axis, do not always extend in a co-lineal or correct manner towards the outer wall of the home appliance. This production and assembly tolerances need of an incremented space for the knob in the exterior wall of the home appliance, having a disadvantageous effect in regards to the knob appearance in regards to the actuation axis and the general impression of the home appliance apparatus.

Therefore, there is a need of knobs for home appliances that may be correctly mounted, despite the production and assembly tolerances, and for a knob to be stable in regards to the actuation axis, as well as leaving a quality impression to the user of the apparatus.

In the prior art, documents exist disclosing such knobs. However, the knobs of the prior art that solve the above problem do not leave a good appearance, do not absorb the variations of the pieces and the assemblies and do not have the versatility to diversify appearances, using always the same internal system, as well as an excess of components.

For example, Brazilian patent No. PI 0105277-2 discloses a coupling system between a knob and home appliances in general. The patent is directed to a system for coupling an action knob, which is responsible for providing action to determined components in a home appliance, in view of its respective command manipulation. The system contains two main parts, the first is basically cylindrical, containing an aperture with a semi-cylindrical section coincidental with the semi-cylindrical format of the front end of the action pole, and provided of vertical lateral sides that limit the formation of an extreme front end, whereas the second part is also basically cylindrical and is provided with vertical and horizontal ease.

Brazilian Patent No. PI 0105346-9 A, also discloses a coupling system between an action and manipulation knob and a home appliance in general. The patent discloses how the knob is destined to interconnect an action pole of a determined component of a home appliance, with its respective manipulation command. The system is made up of two pieces, the first formed by two cylindrical parts, wherein the first cylindrical part is of a lesser diameter and is provided with an aperture in a semi-cylindrical section, coincidental with the front semi-cylindrical format of the action pole, and the second part of greater diameter is provided with two diametric degrees of freedom and internally contains curved walls, which limit it in a spherical housing. The other piece is configured by a disc that has a central spherical projection with coinciding dimensions with the curved walls of the first piece.

French patent No. 2 784 148 refers to the coupling between a control knob and the driven control spindle is provided by an Oldham joint inserted between the control knob and the driven spindle to accommodate offset between their axes. The Oldham joint is enclosed in a connection between the knob and control spindle, formed by pins that engage in cavities at the end of flexible tongues inside the know.

Japanese patent No. 11111112 discloses that around a fitting hole of a knob, a plurality of protrusions formed at pitches of 60 degrees. In a fitting member, with a shaft hole having a fitting plane part at a center of a rotary shaft, a recess part is formed by a protrusion at a pitch of 30 degrees at a outer peripheral part. In the knob, when the fitting member is inserted (press fitted) into the fitting hole, the protrusion is engaged with the recess part and is fitted, and an angle of a display part 1*a* is determined so that the fitting plane part is at a predetermined angle. A switch is fixed to a panel, and the display part can switch the switch at a switching angle matching a scale of a function display of the panel.

British patent No. 2 130 438 discloses a rotary knob for a control device in a household appliance is arranged to be drivingly connected to a rotary actuating shaft of the device and to be recessed in a circular opening in an operating panel or a front wall of the appliance housing so as to be rotatably mounted independently of the shaft. The knob comprises a hub member engaging the actuating shaft, an annular Cardan coupling member having transverse grooves displaced through 90° at both of its end faces, a cover member receiving the hub member and the coupling member and axially detented by means with the hub member, and a cap connected through a detent with the cover member. A rib of the hub member engages into one transverse groove of the coupling member and a rib of the cover member engages into the other transverse groove of the coupling member to permit relative sliding movement of the hub member and cover member to allow for misalignment of the shaft and knob axes.

Finally, British patent No. 2 389 638 refers to a control panel comprises a circuit board carrying a rotary position encoder having a rotating shaft with a first rotation axis and a cover having an aperture. Knob is rotationally received in the aperture with a second rotation axis. The knob has an open interior space and a radial guiding rib projecting into the interior space. A guide part rotates with the rotating shaft and has a guide groove slidably engaging the radial guiding rib whereby the radial guiding rib drives rotation of the rotating shaft in response to manual rotation of the knob. The radial guiding rib radially shifts in position within the guide groove in response to misalignment between the knob and shaft axes. The guide part may have more than one groove and alignment ramps and may be integral or separate from the shaft. The knob may also have an alignment rib.

Therefore, a knob for home appliances that may be correctly mounted in the actuation axes, despite production and assembly tolerances, that absorbs pieces and assembly variations, that uses few components and that is stable with regards to actuation axis is required. Likewise, a knob that has a good visual appearance, leaving an impression of quality to the user of the apparatus, being at the same time sufficiently versatile to diversify appearance using the same internal system, is also required.

DEFINITIONS

As is used in the present document, the term "apparatus" means any home appliance, including dishwashing machines, washing machines, dryers, stoves, ranges, ovens, grates, etcetera, as well as any type of electro-domestics in general, whose actuation is by means of axis and consequently by means of knobs.

As is used in the present document, the term "box" means any type of hexahedron having preferably five solid walls and a hollow wall, and the hexahedron's interior is hollow.

As used in the present, the term "valve" means an actuation axis, wherein it should be understood that valve is any type of mechanism that regulates the communication flow between two parts of the apparatus, helping establish the operation conditions, programming, actuation of indicators, etcetera, including switches to turn on and off the apparatuses, without being limited to the traditional sense of liquid, gas flow, etcetera.

BRIEF DESCRIPTION OF THE INVENTION

The present invention refers to auto-alignable knobs for home appliances, wherein the knobs are adapted to control operations, functions, programming, etcetera, of the apparatus. The knobs are found in visible places of the apparatuses, such as the front part of the apparatus.

The problem to solve, as was stated before, is that during assembly, the valves, which couple to the knobs, do not always extend in a co-lineal or correct manner towards the exterior wall of the front part of the apparatus. The afore may be due to different assembly errors, for example: (a) the axis that will hold the valve or the valve, is not centered in regards to the exterior wall of the front part of the apparatus, or (b) manufacture of certain pieces, for example depending on the material which a certain piece is made, it will be subject to be bent and consequently misalign the valve in regards to the exterior wall. In view of the above, certain production tolerances are allowed, which affect the quality impression of the apparatus to the user and possibly the security of the apparatus.

The auto-alignable knob of the invention, allows correcting these production tolerances by means of the valve alignment with the exterior wall of the front part of the apparatus, allowing the controls to be exactly parallel between themselves in the control module.

FIG. 1*a* shows an example concept in accordance with aspects of the present invention, wherein the figure shows the concept of parallelism, whereas FIG. 1*b* shows the co-linearity between the valve and the knob. FIG. 1*a* shows an axis representation (100) for holding a valve representation (101, 102, 103), wherein the correct alignment of the valve is according to (103). However, due to an assembly error, it is possible that a valve representation (101, 102) is misaligned as shown in FIG. 1*a*. Shown in a front view, the problem is represented in FIG. 1*b*, wherein axis X and Y represent the eccentricity between axis representation (100) and valve representation (101, 102, 103). The axis representation (100) to hold the valve (101) and the valve representation (101) are misaligned as seen in FIG. 1*b*, thus giving an imperfect front appearance of the apparatus. Due to this misalignment between axis (100) and valve (101), a knob (104) could be equally misaligned, and consequently could have the afore disclosed problems. The afore problem is increased when seen in a three-dimensional manner, wherein an axis is added combining three axes X, Y and Z.

An example knob in accordance with aspects of the present invention is made up of at least seven main parts. An offspring box is the piece coupling with the valve. A mobile box houses the offspring box. Both boxes have adequate contact surfaces between themselves. The mobile box allows the offspring box a displacement in X axis. A fixed box houses the mobile box and allows the mobile box a movement in Y axis. Furthermore, the fixed box allows the mobile box to have a certain degree of freedom so that the mobile box rotates. A knob housed in bib is coupled so that it allows a force transmission applied to rotate the knob by the user. The knob may house an insert so that the knob appearance may be diversified, however, the insert is an optional piece. The offspring box, the mobile box, the knob and the fixed box, are housed within the bib, which is capable of housing the whole knob assembly. An elastic member (biasing member), which may be a spring, allows the knob to be oppressed to operate the apparatus, allowing the knob to return to its initial position. Finally, a bib cap keeps the knob assembly assembled, the bib cap is coupled by means of hooks and cavities to the bib. The fixed box houses the elastic member assuring that said member carries out its job in keeping the appearance of the knob assembly and the position of the internal part of the knob assembly.

The X axis movement of the knob assembly is given by the relation between the offspring box and the mobile box, whilst the Y axis movement of the knob housing is given by the relation between the mobile box and the fixed box. The knob assembly rotation is given in view of some ends of the mobile box and a groove in the fixed box. A Z axis movement is obtained by the combination of movements in X and Y axes, between the offset box, the mobile box and the fixed box, as well as the rotation between the mobile box and the fixed box.

Therefore, it is an object of the present invention to provide a knob for home appliance apparatuses that may be correctly mounted in the valves, even with production and assembly tolerances.

Another object of the invention is providing a knob capable of absorbing the piece and assembly variations.

A further object of the invention is providing a knob using few components.

It is an object of the invention providing a knob that has a good visual appearance, and thus, it is an object of the invention that the knob leaves a quality impression to the user of the apparatus.

Finally, it is an object of the present invention providing a knob that is sufficiently versatile to diversify the appearance, using the same internal system.

Other objects and advantages of the invention will become apparent when taking into account the specification in regards to the following figures.

BRIEF DESCRIPTION OF THE FIGURES

The particular features and advantages of the invention, as well as other objects of the invention, will be clear from the following specification, taking into account the following figures, from which:

FIG. 3 is an upper view of a corner of the apparatus, showing the relation between a valve and the exterior wall of the apparatus.

FIG. 4 is a perspective view of the knob assembly of the present invention with a valve.

FIG. 5 is a back perspective view of the knob assembly of the invention with a valve.

FIG. 6 is a perspective view of the valve with the offset box of the invention.

FIG. 7 is a perspective view of the offset box of the invention.

FIG. 8 is a back perspective view of the offset box of the present invention.

DETAILED SPECIFICATION OF THE INVENTION

Figure 1A:
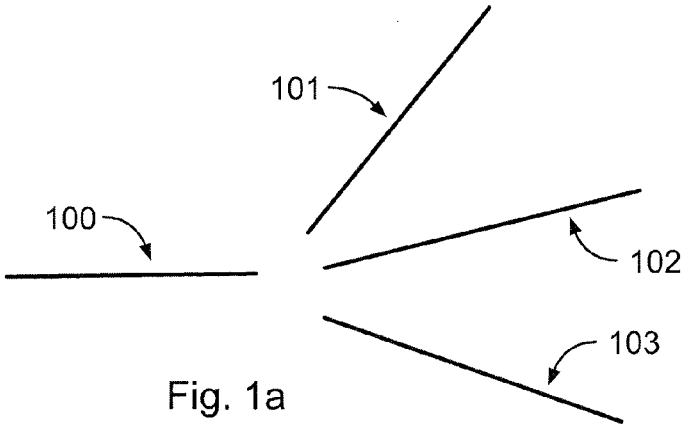
FIG. 1*a* is a figure showing the concept of parallelism of the present invention.
Figure 1B:
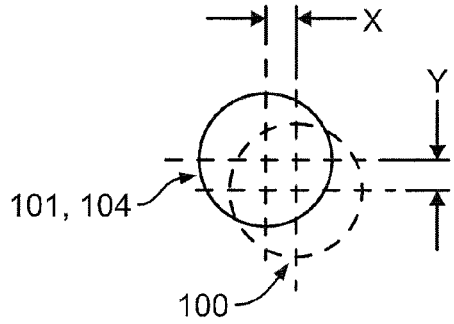
FIG. 1*b* is a figure showing the concept of eccentricity of the present invention.
Figure 2:
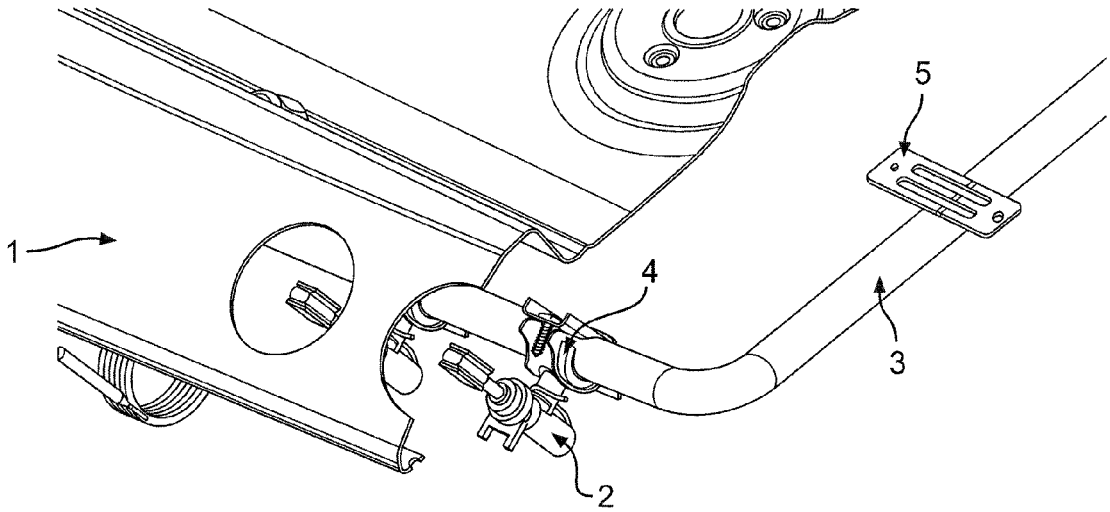
FIG. 2 is a perspective view of a corner of an apparatus, wherein the exterior wall of the corner has a transversal cut, showing the relation between an axis, the valve and the exterior wall of the apparatus.

FIG. 2 shows a corner of a home appliance wall (1), wherein the wall (1) has a transversal cut showing the existing relation between the wall (1), a valve (2) and an alignment axis (3). In the figure, it is appreciated that the apparatus is an oven or range. However, it should be pointed out that the invention may be used in any type of apparatus.

An alignment axis (3) is usually used in home appliances, to hold the valves (2). The axis (3) is held by one of the home appliance walls by means of wings (5), which may be brackets. The valves (2) embrace the axis (3) by means of brackets (4), which may be fastened to the axis by diverse means, such as screws, adhesives, etcetera.

Light and easily workable materials are preferred for the axis (3). During the apparatus assembly, it is possible that the axis (3) may suffer a collision with another part. If the axis (3) suffers a collision, the axis (3) will deform. Likewise, during assembly, it is possible that the brackets (4) are tightened against the axis too much, or tightened less than required, leaving the valve (2) semi-fixed. If the bracket (4) is tightened more than required against the axis (3), the axis (3) will deform.

As shown in FIG. 3, if the axis (3) deforms, an axis (3) and valve (2) with the apparatus wall (1) misalignment will occur. If the bracket (4) is not tightened as required, the bracket (4) will hold on to the axis (3), however, will also be misaligned, misaligning the valve (2) and apparatus wall (1).

Therefore, a large number of unpredictable variables may be created, which on occasions are allowed as tolerances, possibly affecting the quality of the apparatus or the final appearance that the apparatus will have. In other cases, the erroneous variables are not tolerated, and the apparatus will have to be discarded without being sold in the market. Therefore, an important monetary waste in the industry is created by this problem. In other cases the variables are tolerated, and the product goes out to the market, however, the appearance of the product is imperfect, and the products sale is deviated.

FIG. 4 is a front perspective view of the knob assembly (10) of the invention, with a valve (2) connection, which is connected to the axis (3) by means of brackets (4). As will be appreciated, the user of the apparatus will only see in the control panel a knob (11), which will be rotated to operate and control the apparatus. The user will also see the exterior wall (21) of a bib (15), as well as a knob insert (12). Bib 15 may also be referred to as a housing. The use of the parts of the knob assembly (10) and the relation of the parts among each other, will be explained in the following pages. The knob insert (12) is a decorative piece, which is not an indispensable part of the knob (11) of the invention.

FIG. 5 shows a back perspective view of the knob assembly (10). This figure shows the components that will not be visible to the user, such as the valve (2), the axis (3), and its respective brackets (4), as well as an internal part (13) of the knob assembly (10), part of the bib (15) and the bib cap (19).

The valve (2) has an oppressable and rotable shaft (6). When oppressing the knob (11) to operate or control the apparatus, the user causes the oppression of the internal part (13) of the knob assembly (10), causing as well the oppression of the valve (2) shaft (6). When rotating the knob (11) to start the apparatus operation, the user causes the rotation of the internal part (13) of the knob assembly (10), as well as the shaft (6) rotation. Usually, when oppressing the shaft (6), the apparatus is indicated that an existing control change will occur, and allowing thus, the knob (11) rotation. If the shaft (6) is not oppressed, and depending on the apparatus, it is possible that knob (11) rotation is not allowed for security reasons. When the shaft (6) is oppressed and the knob (11) is rotated, the flow of fluid, gas, electricity, etcetera, communication is activated, deactivated, opened, closed or regulated, depending on the function of the control, between the parts of the apparatus. The knob (11) rotation will depend upon the user and the predetermined stops of the valve (2), indicative of a null, minimum, intermediate and maximum flow, or a flow or null flow, depending on the apparatus.

FIG. 6 is a perspective view of the valve (2) and the offspring box (14), showing the relation between the parts. Specifically, the shaft (6) of the valve (2), is essentially cylindrical, with a secant cutting the cylinder, thus making the shaft (6) semi-cylindrical with a flat face.

The offspring box (14), which has a furrow (31) with preferably the same semi-cylindrical figure of the valve shaft (6), is inserted in said shaft (6). Therefore the offspring box furrow (31) encloses one end of the shaft (6), allowing a fixed relation between the valve (2) and the knob assembly (10), and not allowing an easy un-fixing between the two parts.

FIG. 7 is a front perspective view of the offspring box (14). The offspring box (14) is one of components of the internal part (13) of the knob assembly (10). The offspring box (14) is a hexahedron with five solid faces and a semi-solid face. The upper (32) and lower (33) face of the offspring box (14) are flat faces (32, 33), with substantially smooth surface, allowing a easy sliding with the mobile box, which is a further component of the internal part (13) of the knob assembly (10) with which the offspring box (14) will come into contact with, in the exterior part of the offspring box (14) and the interior part of the mobile box. The front face (34) of the offspring box (14) is constituted of three parts, a first part (35) being substantially inverse to a third part (37), wherein both parts are substantially smooth and are secant to the upper (32) and lower (33) face, respectively, as well as a secant to the front face (34). Therefore, the longitude of the second part (36), which is the part of the front face (34), is substantially less to the height of the offspring box (14) since it is cut in the upper part and lower part by the first (35) and second (37) part. The second part (36) will have contact with the end of the mobile box, therefore the lesser surface of the second part (36) with the mobile box (16) assures less friction, and thus avoiding forcing the knob assembly (10) with the valve assembly (2).

Even though in FIG. 7, a single lateral face (38) of the offspring box (14) can be appreciated, in FIG. 8 both lateral faces (38) can be appreciated, wherein it may be noted that both lateral faces (38) are similar. The lateral face (38) has a central groove (39), causing the lateral face (38) to have a pair of projections (40), a first one in the edge with the upper face (32) and a second one in the edge with the lower face (33). The projections (40) allow the offspring box (14) to have the minimum contact and consequently minimum lateral friction with the mobile box. Likewise, the projections allow having a greater contact area between the offspring box (14) and the mobile box (16), giving as a result a greater force transmission.

Even though the contact between the components is necessary, i.e. between the offspring box (14) and the mobile box (16), to assure the correct operation of the knob control of the apparatus, the contact between the components needs to have little fiction to allow movement in the X axis of the knob assembly (10) in regards to the valve (2), during action provision of the knob assembly (10) and valve (2).

FIG. 8 also shows the furrow (31) of the offspring box (14). The furrow (31) is designed in such a manner that it may receive and hold one end of the shaft (6), allowing that the valve (2) and the knob assembly (10) be locked between themselves and that the relation does not unlock easily. The furrow (31) may have any design, as long as it fulfills the above requirement. At the end of the furrow (31), a stop (105) does not allow the insertion of the shaft (6) towards the end of the furrow (31), giving an adequate fit between the shaft (6) and the offspring box (14), allowing the correct functioning between the valve (2) and knob assembly (10) and granting less friction to allow the unlocked position between the shaft (6) and the offspring box (14).

Figure 9:
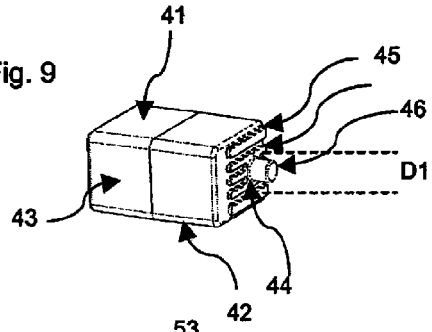
FIG. 9 is a perspective view of the mobile box of the invention.

FIG. 9 shows the mobile box (16) in a perspective view. The mobile box is a hexahedron with five solid faces, and a hollow face. The upper (41), lower (42) and front (43) faces, are substantially smooth, and do not have contact with the fixed box, which is a further component of the internal part (13) of the knob assembly (10). The mobile box (16) for its lateral exterior part, will have contact and friction with the interior part of the fixed box.

Figure 10:
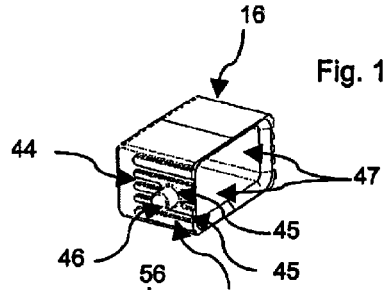
FIG. 10 is a back perspective view of the mobile box of the invention.

As may be appreciated in FIGS. 9 and 10, the lateral faces (44) are substantially similar and contain a plurality of undulations (45). The undulations (45) allow that not all the surface of the lateral face (44) is in contact with the internal lateral part of the fixed box, rather just the undulations (45), which have a total surface less than the total surface of the lateral face (44), be in contact with the internal lateral part of the fixed box. The mobile box (14) lateral face (44) additionally comprises a pin (46) in each lateral face (44), to assure the mobile fastening between the mobile box (16) and the fixed box, and to allow the rotational freedom degree between the mobile box (16) and the fixed box, as will be described.

The mobile box (16) interior faces (47), as shown in FIG. 10, are substantially smooth, to allow the movement in an X axis of the offspring box (14) within the mobile box (16). The exterior volume of the offspring box (14) is less than the interior volume of the mobile box (16). However, the length of the mobile box (16) interior volume is less then the length of the offspring box (14) exterior volume. Therefore, due to the offspring box (14) exterior volume and the mobile box (16) interior volume, as well as the mobile box (16) internal part, and the reduced friction between the two components, a lateral sliding movement is allowed between the offspring box (14) and the mobile box (16), translating in a Y axis movement of the knob assembly (10).

Figure 11:
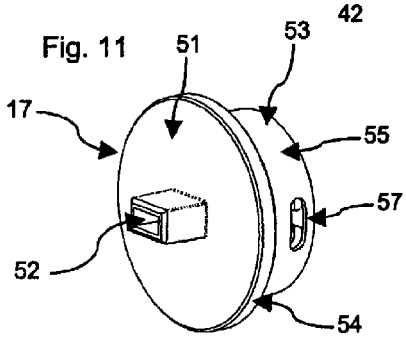
FIG. 11 is a perspective view of the fixed box of the present invention.

FIG. 11 shows a front view of the fixed box (17). The fixed box (17) has a circular shaped front face (51) to fit with the back face of the knob (11), however, the front face (51) may have any shape as long as it fits with the back face of the knob (11). The front face (51) is substantially smooth, however, in the center part, said face (51) has an extension (52) in a substantially hexahedra shape. The faces of said extension (52) are substantially smooth. The fixed box (17) will be fastened with the back face of the knob (11) by means of the insertion of said extension (52) in a notch (61) of the knob (11), wherein the notch (61) of the groove (11) will have substantially the same shape than the extension (52) and a slightly bigger volume. Therefore, the shape of the notch (61) may be any, as long as it is the same as the shape of the fixed box (17) extension (52) and as long as a slight interference exists, assuring the fastening of the two pieces.

Figure 12:
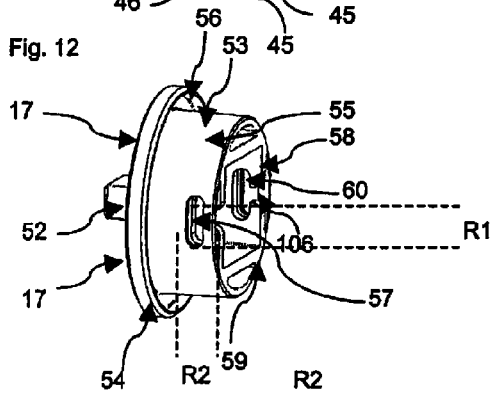
FIG. 12 is a back perspective view of the fixed box of the present invention.

In reference to FIGS. 11 and 12, the fixed box (17) has a lateral face (53), which, in this embodiment, is cylindrical. The lateral face (53) has a skirt (54) and a main surface (55). Skirt 54 may also be referred to as a periphery of fixed box 17. The skirt (54) has a first cylindrical volume, whereas the main surface (55) has a second cylindrical volume, wherein the first cylindrical volume is greater than the second cylindrical volume. The skirt (54) has contact with the front face (51) edge and with a groove (56) formed between the skirt (54) and the main surface (55). The groove (56) is substantially perpendicular to the skirt (54) and the main surface (55). The groove (56), will capture and house a first end (71) of the elastic member (18), as may be a spring.

The main surface (55) is substantially smooth and contains two indentations (57) which are diametrically opposed. The indentations (57) coincide in the same horizontal plane than the front face (51) extension (52). The indentation (57) is substantially oval, having a length $R_1$ and width $R_2$, wherein $R_1$ is greater than $R_2$.

Figure 13:
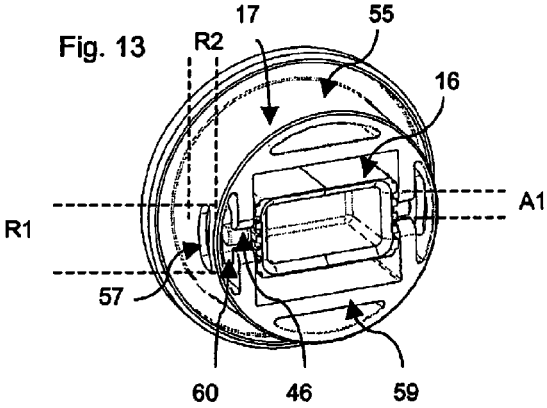
FIG. 13 is a back perspective view of the mobile box assembled with the fixed box.

The fixed box (17) front face (58), as seen in FIGS. 12 and 13, contain a hollow cylinder, wherein a hexahedron (59) is housed, from which five of the faces are solid, and one face is hollow. The cylindrical shape, is the lower edge of the main surface (55) of the lateral face (53). The surface between the lower edge of the main surface (55) and the hexahedron (59) is substantially hollow. However, the surface between the lower edge of the main surface (55) and the hexahedron (59) could be a solid surface. The upper and lower internal faces of the hexahedron (59) are substantially smooth. The lateral faces of the hexahedron (59), which are substantially smooth, contain an indentation (60) that also coincides in the same horizontal plane of the fixed box (17) front face (51) extension (52), thus coinciding with the indentation (57) of the fixed box (17) main surface (55) thus being opposed. The hexahedron (59) indentation (60), as the main surface (55) indentation (57), is substantially oval and has a $R_1$ and width $R_2$, wherein $R_1$ is greater than $R_2$.

FIG. 12 shows the lateral face (53) main surface (55) indentation (57), which is indicative of the position of the hexahedron (59) indentation (60). The hexahedron (59) indentation (60), in the proximal part to the back face (58) and distal to the front face (51) of the fixed box (17), has a groove (106). The groove (106) is preferably centered with regards to length $R_1$. The groove (106) has a width $A_1$. The mobile box (16) lateral face (44) ends (46), which have a diameter $D_1$, wherein $D_1$, is greater than $A_1$, are forced by said groove (106), preferably by pressure. Since $D_1$ is slightly greater than $A_1$, the mobile box (17) will be attached in an X axis with the fixed box (17), however, since the fixed box (17) volume is substantially greater than the mobile box (16) volume, and since $R_1$ is substantially greater than $D_1$, the mobile box (16) is found in a movement free relation in Y axis with regards to the fixed box (17).

The fixed box (17) hexahedron (59) internal volume, as shown in FIG. 13, is substantially greater to the mobile box (16) exterior volume. The length, width and height of the fixed box (17) hexahedron (59) interior volume, is greater to the length, width and height of the mobile box (16) interior volume. Since the fixed box (17) internal volume is substantially greater than the mobile box (16) external volume, the fixed box (17) internal volume allows an almost free rotation of the mobile box (16) within the fixed box (17). Therefore, since the mobile box (16) external volume and the fixed box (17) hexahedron (59) internal volume, as well as the fixed box (17) hexahedron (59) internal part surface, the mobile box (16) external part surface, the length R1 and width R2, the hexahedron (59) indentation (60), as well as diameter D1 with regards to length R1, and reduced friction between both components, a horizontal sliding movement is allowed between the fixed box (17) and mobile box (16), which translates into a Y axis movement of the knob assembly (10).

Figure 14:
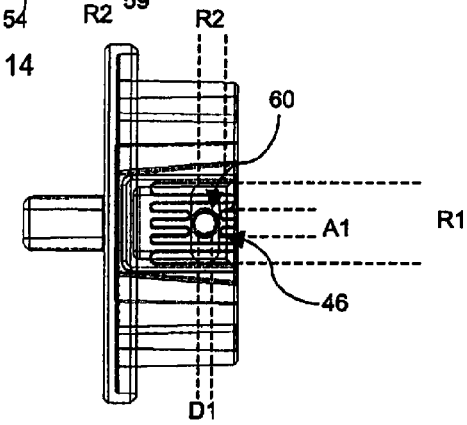
FIG. 14 is a left lateral view of a transversal cut of the mobile box assembled with the fixed box.

FIG. 14 shows in a clearer manner the relation between end (46) with hexahedron (59) indentation (60). The end (46) being cylindrical, has a diameter $D_1$. The relation between the dimensions is $R_1>R_2>D_1>A_1$. R1 is substantially greater than $R_2$, while $R_2$ is slightly greater than $D_1$. Likewise, $D_1$ is slightly greater than $A_1$. Since $R_1$ is substantially greater than $D_1$ and since $R_2$ is slightly greater than $D_1$, a free Y axis movement of the mobile box (16) with regards to the fixed box (17) is allowed, transforming into a Y axis movement of the knob assembly (10). Since $R_2$ is slightly greater than $D_1$, a rotation of the mobile box (16) with regards to the fixed box (17) is allowed, transforming into a rotational movement of the knob assembly (10). Finally, since $D_1$ is slightly greater than $A_1$, and since the mobile box (16) is inserted by pressure into the fixed box (17), the mobile box (16) is fastened to the fixed box (17) without the possibility that the mobile box is detached while sliding through length $R_1$ or rotating.

Figure 15:
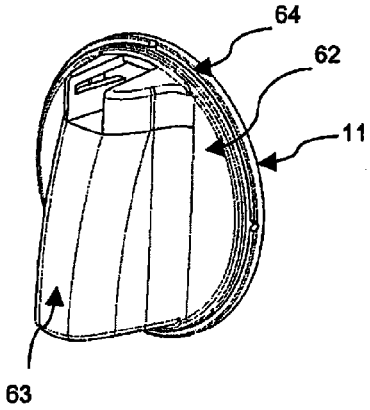
FIG. 15 is a perspective view of the knob.

FIG. 15 is a front perspective view of the knob (11) without the insert (12). The knob (11) consists preferably of a base (62) which has the same major surface of the fixed box (17) front face (51), since the knob (11) will cover the fixed box (17). The knob (11) also consists preferably of a lever (63) which runs throughout most of the knob (11) diameter. The lever (63) helps the apparatus user to rotate the knob to initiate apparatus operation, turning on or off the apparatus, programming the apparatus, etc. The knob (11) also consists of a skirt (64) which is found surrounding the knob (11) base (62). Skirt 64 may also be referred to as a periphery of knob 11.

When the lever (63) is oppressed by the user and rotated, the lever (63), the base (62) and the skirt (64) are rotated in a uniform manner for being part of the same piece. Since the elastic member (18) will be housed by the groove (56) formed by the lateral face (53) skirt (54) and the fixed box (17) main surface (55), and the bib cap (19) as will be shown later, the elastic member (18) is constantly producing force against the fixed box (17) and the knob (11). That is, when the user oppresses the knob (11), a contrary force is made by the elastic member (18), thus the user has to make an effort to oppress the knob (11). When the user stops making oppression force, the elastic member (18) tends to spring back to its resting state, pushing the fixed box (17) and knob (11) towards the apparatus exterior. The skirt (64) averts that the knob (11) goes out the knob assembly (10), since it makes contact with an interior burr (22) of the bib (15).

The knob (11) skirt (64) has the same diameter than the fixed box (17) lateral face (53) skirt (54), so that both skirts (64, 54) do friction and contact work with the bib (15) internal surface (25) as will be described.

Figure 16:
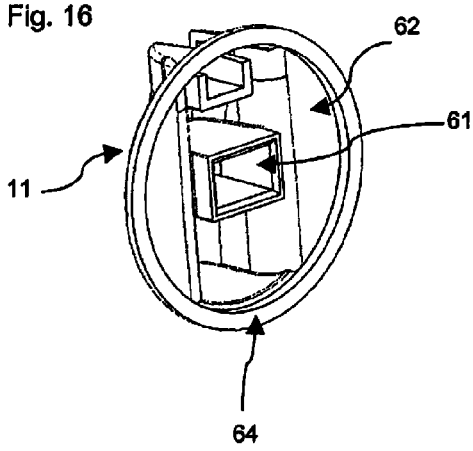
FIG. 16 is a back perspective view of the knob.

FIG. 16 is a back perspective view of the knob (11). In the present figure, it may be appreciated how the skirt (64) surrounds the knob base (62). Likewise, the knob notch (61) may be appreciated. As stated before, the fixed box (17) will be fastened in the knob (11) back face, by means of inserting the fixed box (17) front face (51) extension (52) in the knob notch (61), wherein the knob notch (61) has substantially the same shape than the extension (52), simply with a slightly greater volume. Therefore, the form of the knob notch (61) may have any shape, as long as it coincides with the fixed box (17) extension (52) shape.

Figure 17:
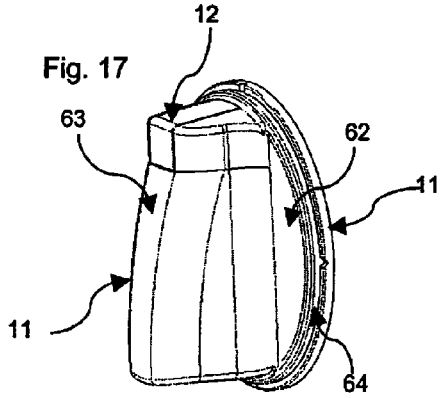
FIG. 17 is a perspective view of the knob with the knob insert.

Regarding FIG. 17, a knob (11) may be seen with the same features than the knob (11) of FIG. 15, except that the knob (11) of FIG. 17 has an insert (12). The insert (12) is inserted in the lever (63) aperture, and by means of a hook (91) and an insert (12) skirt (92), the insert (12) is coupled and fastened to the lever (63). The insert (12) is an optional piece that may be considered decorative in nature. The insert (12) visually signals to the user the position of the lever (63) and knob (11), thus indicating the operation being carried out by the apparatus, or the programmed operation to carry out, or the actual state of the apparatus, etc. The insert (12) may well be substituted by a continuous lever (63).

Figure 18:
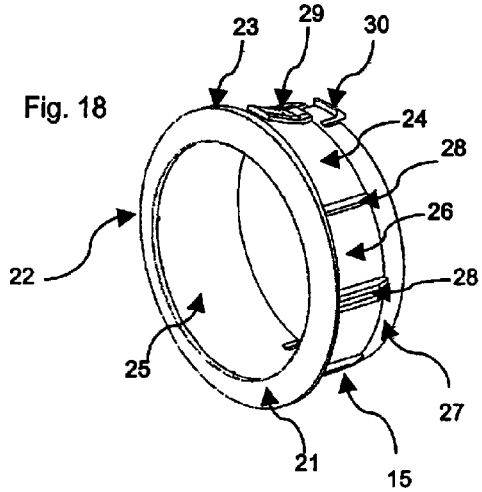
FIG. 18 is a perspective view of the bib.

FIG. 18 is a perspective view of the bib (15). The bib (15) is the knob assembly (10) component housing all the above mentioned parts of the knob assembly (10) including the elastic member (18) shown and described in FIG. 20. Said bib (15) has a generally ringed shape, however, may have any form that fits with the knob assembly in general, as long as it has an aperture in its center. The bib (15) has an exterior wall (21) as was mentioned before, which will be visible to the apparatus user. The exterior wall (21) has an interior burr (22) and an exterior bur (23). The exterior burr (23) allows coupling the knob assembly (10) to the apparatus. That is, the bib (15) exterior burr (23) does not allow that the knob assembly (10) be sunk towards the interior of the apparatus, when the knob assembly (10) is oppressed for its operation or programming.

The bib (15) contains a lateral face (24) having a smooth interior surface (25). The interior surface (25) will be in contact with the knob skirt (64), thus when operating the knob (11), the interior surface (25) will have friction with the skirt (64). Likewise, the diameter of the skirt (64) is slightly less than the bib (15) interior surface (25) diameter. Therefore, said contact and friction between the interior surface (25) and skirt (64), as well as the diameter difference, does not allow the knob (11), when oppressed, to be turned in regards to the knob assembly (10), securing that the knob (11) will always face the user. As was stated before, to improve the contact and friction work between the parts, preferably the fixed box (17) skirt (54) diameter is the same as the knob (11) skirt (64), therefore, both skirts (54, 64) carry out contact and friction work against the bib (15) interior surface (25).

The lateral face (24) in its exterior surface, is made of two parts, a main surface (26) and a secondary surface (27). Both surfaces (26, 27) form a part of the bib (15) ring, wherein the secondary surface (27) has a diameter slightly less than the main surface (26) diameter. The main surface (26) has a plurality of undulations (28) which allow aligning the knob assembly (10) with the apparatus when coupling the knob assembly (10) with the apparatus. Additionally, the main surface (26) has at least one tongue (29) that works as a trap. Since the tongue (29) is deformable, and since the tongue (29) is in contact with the main surface (26) in its back part, and while approaching the exterior wall (21), the contact ceases, the tongue (29) pulling away from the main surface (26) and closing in to said exterior wall (21), when the knob assembly (10) is inserted in the apparatus, the tongue (29) allows the knob assembly (10) to be inserted in the apparatus, however does not allow the knob assembly (10) to be extracted from the apparatus, since the part of the tongue (29) proximal to the exterior wall (21), which is most the most separated part of the tongue from the main surface (26), will block the knob assembly with regards to the apparatus, thus the tongue (29) working as a trap.

The secondary surface (27) is substantially uniform, except that it contains at least a pair of hooks (30). The hooks (30) are fixed with the bib cap (19) locking the knob assembly (10) components, as will be explained. The hooks (30) are preferably diametrically opposed.

Figure 19:
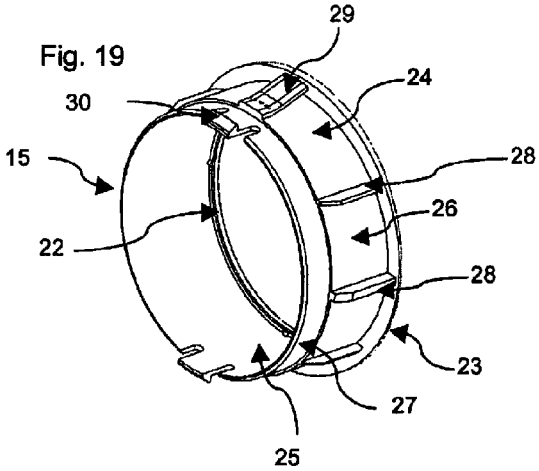
FIG. 19 is a back perspective view of the bib.

FIG. 19 shows in a clearer manner the bib (15) exterior wall (21) exterior burr (23). Likewise, the undulations (28) and tongue (29) are shown in the main surface (26) of the bib (15) lateral face (24) and the hooks (30) of the bib (15) secondary surface (27).

Figure 20:
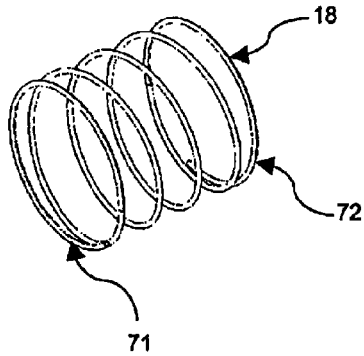
FIG. 20 is a perspective view of the spring.

FIG. 20 shows the elastic member (18). In its first end (71), the elastic member (18) preferably has a diameter similar to the fixed box (17) lateral face (53) groove (56). In its second end (72), the elastic member (18) preferably has a similar diameter to the bib cap (19) groove (81). Both grooves (56, 81) may have a similar diameter, or coincide in diameters, thus both ends (71, 72) may have a similar diameter.

Figure 21:
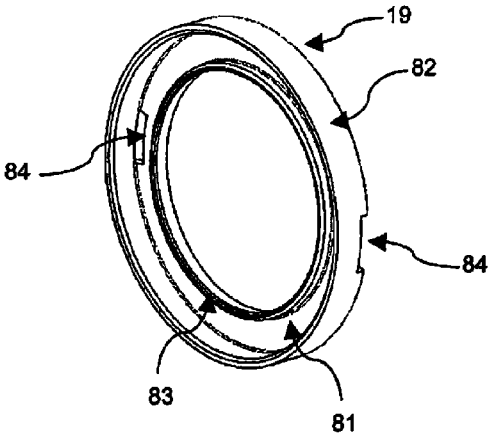
FIG. 21 is a perspective view of the bib cap.

FIG. 21 shows a front view of the bib cap (19). The bib cap (19), is comprised by an external skirt (82) and an internal skirt (83). The bib cap (19), being the same shape as the bib (15), has in its center an aperture. Both skirts (82, 83) have a ring shape, and form between them the groove (81) that will capture the elastic member (18) second end (72), housing the elastic member end (72) in the groove (81) between said skirts (82, 83). In the borders between the external skirt (82) with the groove (81), at least two cavities (84) are found, which are diametrically opposed. The cavities (84) are designed to capture and house the hooks (30) coming from the bib (15) secondary surface (27). The external skirt (82) diameter is the same or similar to the bib (15) lateral face (24) main surface (26) diameter. Therefore, the lateral face (24) secondary surface (27) diameter is less than the external skirt (82) diameter, thus, when the knob assembly (10) is assembled, the bib (15) lateral face (24) secondary surface (27) goes through the bib cap (19) and the cavities (84) capture and fasten the hooks (30) of the bib (15) second surface (27).

Figure 22:
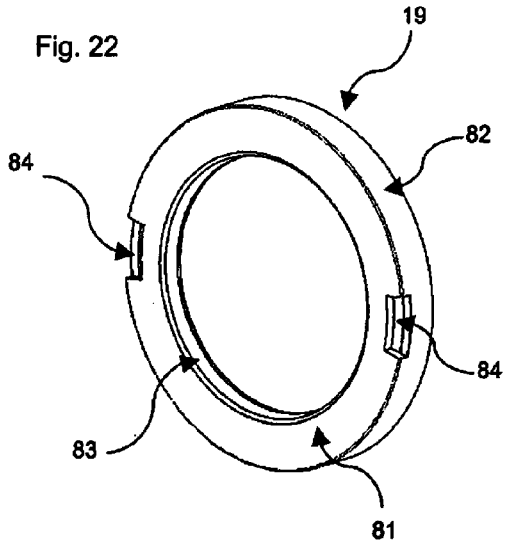
FIG. 22 is a back perspective view of the bib cap.

FIG. 22 shows a back view of the bib cap (19). In this view, the internal skirt (83), the external skirt (82) and cavities (84) are shown in a clearer manner. Likewise, the surface of the groove (81) that will capture the elastic member (18) and house the member (18) second end (72) are shown.

Figure 23:
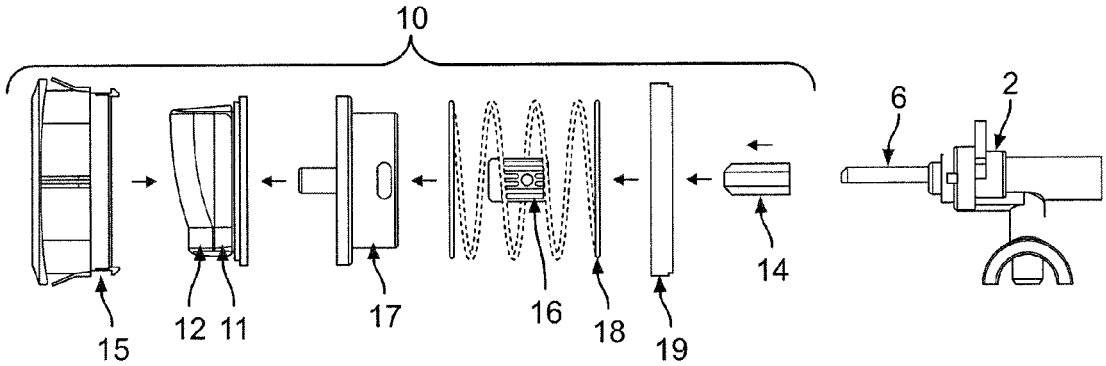
FIG. 23 is a left lateral view of the knob assembly components in explosion and a valve, showing the assembly sequence.

FIG. 23 is an explosion view of all the components of the knob assembly (10) and a valve (2).

The valve (2), in one of its ends, has the shaft (6) that will be inserted in the offspring box (14) furrow (31). The furrow (31) is capable of receiving the shaft (6) in view of its similar shapes. The interior part of the furrow (31) contains a stop (105) limiting the insertion of the shaft (6) in the interior of the furrow (31).

The mobile box (16) is inserted to the fixed box (17) by means of mobile box (16) ends (46), as well as by the fixed box (17) back face (58) hexahedron (59) indentation (60) groove (106).

Once the mobile box (16) is coupled with the fixed box (17), the fixed box (17) is coupled with the knob (11) by means of the insertion of the extension (52) in the fixed box (17) front face (51), in the notch (61) of the knob. The knob (11), the fixed box (17) and mobile box (16) are assembled in the same piece.

The bib (15) is inserted by the front part of the knob (11), wherein the bib (15) by means of its aperture, is capable of receiving the knob (11), the fixed box (17) and the mobile box (16) assembled before. The knob (11) skirt (64) makes contact with the bib (15) inner burr (22), thus the knob assembly (11), fixed box (17) and mobile box (16) is fixed with regards to the bib (15).

The elastic member (18) is inserted in the hole formed by the diameter difference of the fixed box (17) and the bib (15). The main surface (55) fixed box (17) diameter is less than the bib (15) lateral face (24) interior surface (25). The elastic member (18) first end (71), is captured by the groove (56) of the fixed box (17) lateral face (53), wherein the groove (56) houses the member (18) end (71), between the skirt (54) and the main surface (55).

The hooks (30) in the bib (15) secondary surface (27) receives, by means of the cavities (84) the bib cap (19). Since the hooks (30) and the cavities (84) are diametrically opposed, the hooks (30) and cavities (84) are aligned.

The insert (12) may be coupled with the knob (11) at any time during the knob assembly (10) construction.

The knob assembly (10) is assembled. Finally, the knob assembly (10) is coupled with the valve (2) by means of the connection between the mobile box (16), the offspring box (14) and the valve (2) shaft (6).

Figure 24:
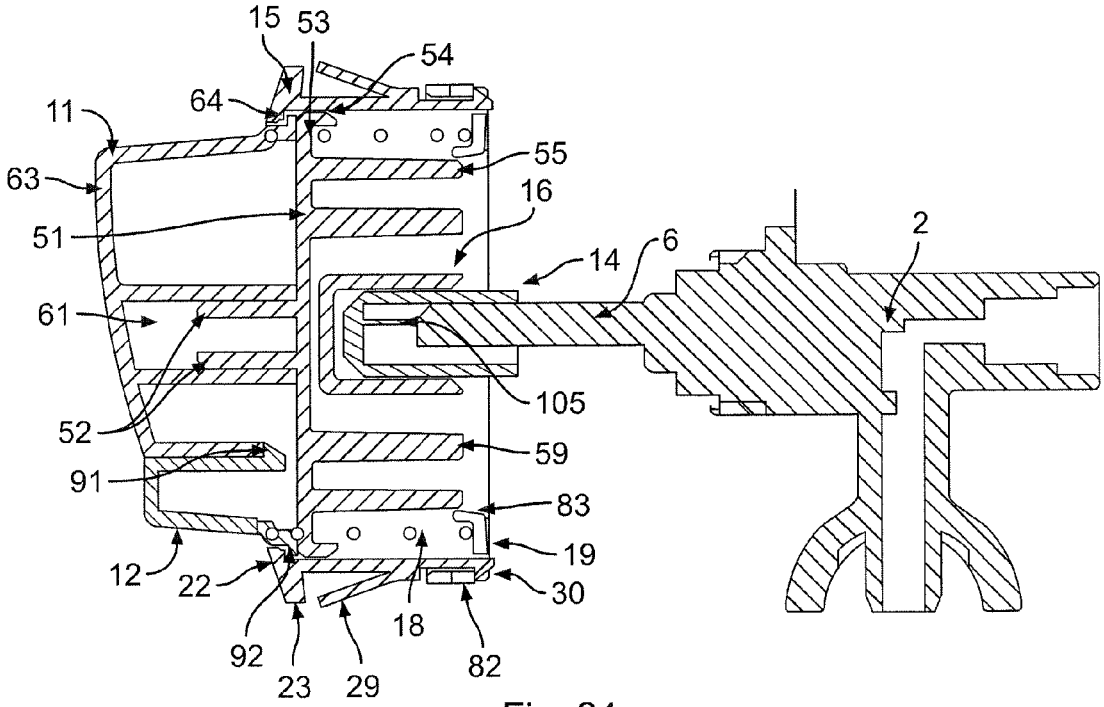
FIG. 24 is a left lateral view of a transversal cut of the knob assembly of the present invention with a valve.

FIG. 24 is a transversal cut of the knob assembly (10) and valve (2). The knob assembly (10) is comprised by the offspring box (14) whose stop (105) limits the entry of the shaft (6) within said offspring box (14). The offspring box (14) is housed within the mobile box (16). The mobile box (16) is housed within the fixed box (17) hexahedron (59), who has a main surface (55) and a skirt (54), forming a groove (56) capable of capturing and housing the elastic member (18) first end (71). The elastic member (18) second end (72) is captured and housed by the groove (81) formed by the external skirt (82) and internal skirt (83) of the bib cap (19). Also, a tongue (29) in the bib (15) lateral face (24) main surface (26) is shown, as well as the bib (15) exterior burr (23). The fixed box (17) front face (51) extension (52) is also shown, which is coupled by means of the insertion of said extension (52) in knob (11) notch (61). The insert (12) is coupled by means of a hook (91) to the knob (11) and by means of a skirt (92) to the bib (15).

It is important to note the relation existing between the diameters of the bib (15) interior burr (22), the knob (11) skirt (64) and the fixed box (17) lateral face (53) skirt (54). The bib (15) interior burr (22) achieves capturing the knob (11) by means of said skirt (64). Since the elastic member (18) is making constant force against the groove (56) to achieve its resting state, said knob (11) skirt (64) will always have contact with the fixed box (17) lateral face (53) skirt (54). Both skirts (64, 54) preferably have the same diameter to work the contact and friction mentioned before, with the bib (15) lateral face (24) interior surface (25). The insert (12) skirt (92), does the same work than the knob (11) skirt (64). The knob (11), instead of the insert (12), could have an extension of its lever (63), thus said knob (11) would need a second skirt (64) in its opposed side to the first skirt (64).

Figure 25:
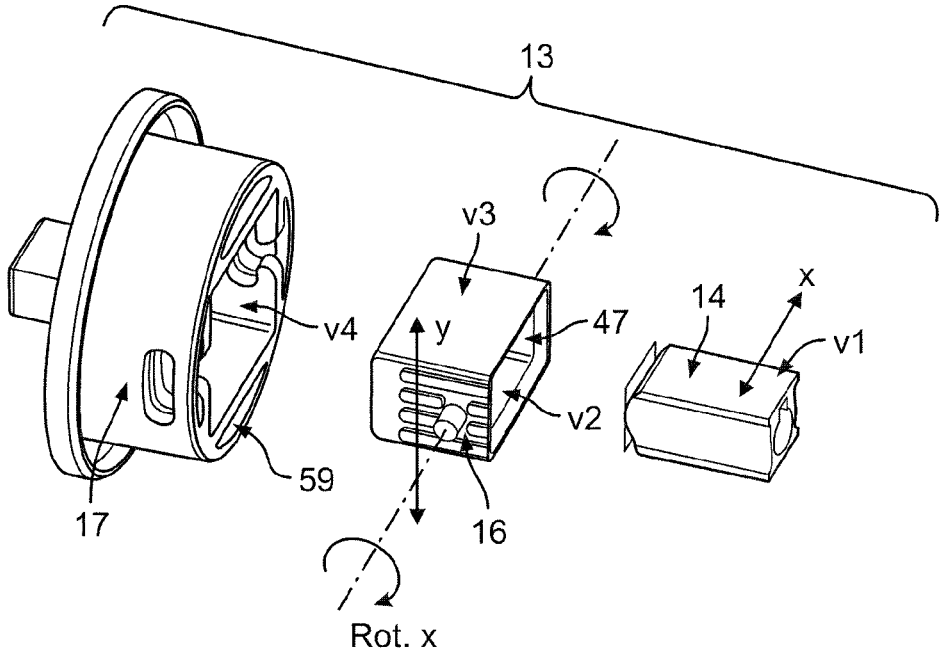
FIG. 25 is a perspective view of the fixed boxy, the mobile box and the offset box, showing the movement obtained by the knob of the present invention.

FIG. 25 shows how the internal components (13) of the knob assembly (10) work. The mobile box (16) interior faces (47) create an internal volume which is substantially greater than the exterior volume of the offspring box (14). The offspring box (14) exterior volume will be named $V_1$. The mobile box (16) interior volume will be named $V_2$. It should be noted that the length of $V_2$ is less than the length of $V_1$. Therefore, due to $V_2$ and $V_1$, as well as the internal part of the mobile box (16) and the reduced friction between the two components, a lateral sliding movement is allowed between the offspring box (14) and the mobile box (16), which is translated in an X axis movement of the knob assembly.

The exterior volume of the mobile box (16) will be named as $V_3$. The hexahedron (59) interior volume will be named as $V_4$. $V_4$ is substantially greater than $V_3$. The length, width and height of $V_4$, is greater to the length, width and height of $V_3$. Since $V_4$ is substantially greater to $V_3$, $V_4$ allows an almost free rotation of the mobile box (16) within the fixed box (17). Therefore, since $V_3$ and $V_4$, as well as the fixed box (17) hexahedron internal part surface, the mobile box (16) external part surface, length $R_1$ and width $R_2$ of the hexahedron (59) indentation (60), as well as diameter $D_1$ with regards to length $R_1$ and the reduced friction between the two components, a horizontal sliding movement is allowed, between the fixed box (17) and the mobile box (16), which is translated into a Y axis movement of the knob assembly (10).

The almost free rotation of the mobile box (16) within the fixed box (17) in view that $V_4$ is substantially greater than $V_3$, as well as diameter $D_1$ in regards to width $R_2$, along with the Y axis movement, as well as along with the X axis movement of the knob assembly (10), is translated into a Z axis movement of the knob assembly (10).

Figure 26:
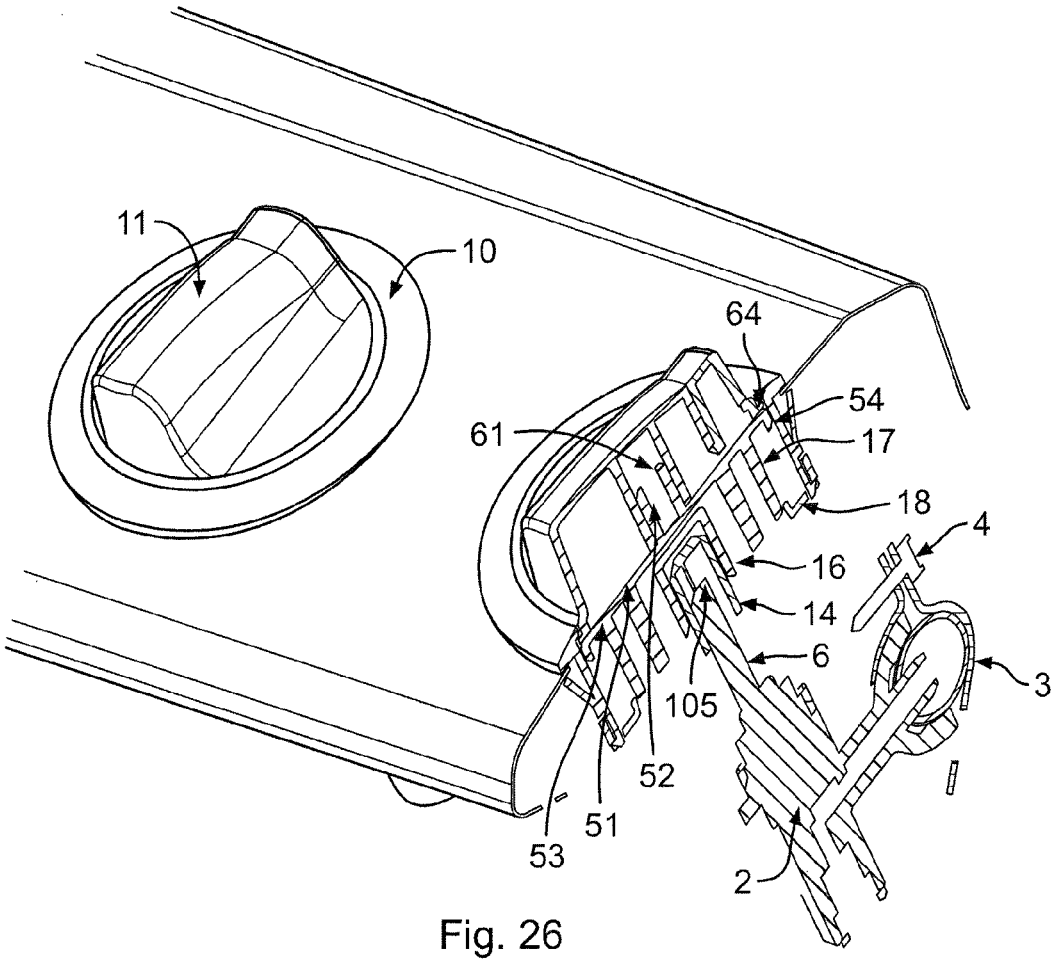
FIG. 26 is a perspective view of the wall of a home appliance apparatus with the knobs of the present invention, wherein the wall and one of the knobs has a transversal cut, showing the assembly of the knobs with the wall.

Finally, FIG. 26 is a perspective view of the control of the apparatus, with one of the knob assemblies (10) in transversal cut. The axis movements of the knob assembly, allow the valve and corresponding shaft (6) to be totally misaligned with regards to the alignment axis (3), or the brackets (4) to be misaligned to said valve (2), wherein the knob assembly (10) of the invention, will guarantee a correct connection between the valve (2) and the knob assembly (10), that is, the assembly (10) be stable with regards to the valve (2) and allow having a good visual appearance to the user of the controls, leaving a quality impression to the user of the apparatus.

Explaining the basic operation of the knob assembly (10), when the user oppresses the knob (11) to indicate or program the operation of the apparatus, the user makes a contrary force to the elastic member (18). When oppressing the knob (11), the user oppresses the fixed box (17) by the existing contact between the knob (11) skirt (64) and the fixed box (17) front face (51) skirt (54). The fixed box (17) is also pushed by the existing contact between the knob (11) notch (61) walls and the fixed box (17) front face (51) extension (52).

The fixed box (17) housing the elastic member (18) in its groove (56), when pushed, starts creating a greater force to the elastic member (18). The mobile box (16) and offspring box (14) are pushed as a consequence of the force being created by the user, since both boxes (14, 16) are housed within the fixed box (17). The above-mentioned components may be pushed freely, since the fixed box (17) main surface (55) diameter is less than the bib cap (19) diameter, keeping together all of the knob assembly (10). As a consequence, the main surface (55), the hexahedron (59), the mobile box (16) and the offspring box (14), may penetrate through the aperture of the bib cap (19), and said parts are stopped by the resistance created by the elastic member (18). The offspring (14) stop (105) pushes the valve (2) shaft (6) in the same sense than the user is pushing the knob (11). Therefore, when pushing the valve (2) shaft (6), it is indicated to the apparatus that the operation will be changing or modifying the operation of one of its parts. The shaft (6) may be rotated as previously configured by the valve (2).

Alterations of the structure disclosed in the specification, may be provided by those skilled in the art. However, it must be understood that the specification relates to the preferred embodiments of the invention, which is for illustrative purposes only, and should not be construed as a limitation of the invention. All modifications that do not depart from the spirit of the invention will be included in the scope of the enclosed claims.

The invention claimed is:

1. An auto-alignable knob assembly for a home appliance comprising:

an offspring box including a furrow configured to receive a shaft of a valve;

a mobile box, wherein one face of the mobile box is open, wherein each lateral face of the mobile box has a pin, wherein the mobile box receives the offspring box through the open face and wherein the offspring box and the mobile box have a free movement relative to one another along a first axis;

a fixed box having a face that defines an hexahedron and a front face positioned mutually opposite to the face with the hexahedron, the front face having at least one extension, wherein each lateral side of the hexahedron includes an indentation and a groove that provides access to the indentation, wherein the mobile box is insertable to the fixed box by insertion of the respective pins of each lateral face through corresponding grooves, and wherein the pins of the mobile box provide a respective free movement to the mobile box relative to the indentations of the fixed box along at least a second axis orthogonal to the first axis;

a knob including at least one notch configured to receive the at least one extension of the front face of the fixed box and further including a lever;

a biasing member configured to bias the knob relative to the fixed box;

a housing arranged to house the offspring box, the mobile box, the fixed box and at least part of the knob; and a cap arranged to enclose the housing and the boxes housed by the housing, and having contact with an end of the biasing member.

2. The knob according to claim 1, wherein the offspring box comprises at least one projection in each lateral face, the at least one projection positioned to contact an internal face of the mobile box, and additionally comprising at least one stop for preventing the insertion of the shaft towards a distal end of the offspring box.

3. The knob according to claim 1, wherein each lateral face of the mobile box comprises a plurality of undulations arranged to contact an internal section of the fixed box.

4. The knob according to claim 1, wherein the indentation has a length $R_1$ and a width $R_2$, wherein $R_1$ is greater than $R_2$, wherein said groove has a width $A_1$ and wherein the pin of the offspring box has a diameter $D_1$, wherein $R_2>R_1>A_1>D_1$.

5. The knob according to claim 1, wherein the respective indentations on each lateral side of the hexahedron are oval-shaped and are positioned mutually opposite to one another.

6. The knob according to claim 1, wherein the fixed box includes a lateral face that defines a first annular groove that receives a first end of the biasing member and wherein the fixed box includes a periphery that defines a second annular groove that receives a second end of the biasing member.

7. The knob according to claim 1, wherein a back face of the knob is coupled to the front face of the fixed box, and wherein the lever comprises an insert indicative of a state of the knob.

8. The knob according to claim 1, wherein the housing defines an aperture, wherein an external section of the housing includes a plurality of undulations, at least one tongue adapted to receive and fasten the knob assembly with the appliance, and at least one cavity, and further wherein the cap includes at least one hook to be inserted within the at least one cavity of the housing.

9. The knob according to claim 1, wherein the cap includes at least one aperture that allows travel to the offspring box, the mobile box and at least part of the fixed box when the knob is depressed.

10. The knob according to claim 9, wherein a periphery of the knob makes contact with an internal burr of the housing to couple the fixed box and the mobile box to the housing.

11. The knob according to claim 1, wherein a mechanical coupling established between the indentations of the fixed box and the pins of the mobile box is configured to provide a rotational degree of freedom about one of the axes.

12. The knob according to claim 11, wherein a combined mechanical coupling established between the offspring box, the mobile box and the fixed box is configured to provide a respective degree of freedom along a third axis orthogonal to the first and second axes.

13. An auto-alignable knob for a home appliance comprising:

an offspring box connected to a valve shaft;

a mobile box having at least one lateral face and including a pin in the lateral face, wherein the mobile box is coupled to the offspring box to allow a free movement relative to one another along a first axis;

a fixed box including an indentation and a groove, wherein the mobile box is insertable to the fixed box by insertion of the pin of the lateral face through the groove, and wherein the pin of the mobile box provides a respective degree of freedom to the mobile box relative to the indentation of the fixed box along at least a second axis orthogonal to the first axis;

a knob including a lever;

a biasing member arranged to bias the knob relative to the fixed box;

a housing arranged to house the offspring box, the mobile box, the fixed box and at least part of the knob; and a cap arranged to enclose the housing, and having contact with an end of the biasing member.

14. The knob according to claim 13, wherein a mechanical coupling established between the indentation of the fixed box and the pin of the mobile box is configured to provide a degree of rotational freedom about one of the axes, and further wherein a combined mechanical coupling established between the offspring box, the mobile box and the fixed box is configured to provide a respective degree of freedom along a third axis orthogonal to the first and second axes.

* * * * *